US010053764B2

(12) United States Patent
Larsson et al.

(10) Patent No.: US 10,053,764 B2
(45) Date of Patent: Aug. 21, 2018

(54) METHOD AND STEEL COMPONENT

(71) Applicant: AKTIEBOLAGET SKF, Göteborg (SE)

(72) Inventors: Staffan Larsson, Göteborg (SE); Walter Datchary, Göteborg (SE); Isabella Flodström, Göteborg (SE); Peter Neuman, Göteborg (SE)

(73) Assignee: AKTIEBOLAGET SKF, Gothenburg (SE)

( * ) Notice: Subject to any disclaimer, the term of this patent is extended or adjusted under 35 U.S.C. 154(b) by 294 days.

(21) Appl. No.: 14/422,726

(22) PCT Filed: Aug. 19, 2013

(86) PCT No.: PCT/SE2013/000126
§ 371 (c)(1),
(2) Date: Feb. 20, 2015

(87) PCT Pub. No.: WO2014/031052
PCT Pub. Date: Feb. 27, 2014

(65) Prior Publication Data

US 2015/0240341 A1 Aug. 27, 2015

(30) Foreign Application Priority Data

Aug. 21, 2012 (SE) ..... 1200503

(51) Int. Cl.

| | |
|---|---|
| ***C23C 8/32*** | (2006.01) |
| ***C21D 1/06*** | (2006.01) |
| ***C21D 9/36*** | (2006.01) |
| ***C23C 8/80*** | (2006.01) |
| ***C23C 8/34*** | (2006.01) |
| ***C21D 9/40*** | (2006.01) |
| ***C22C 38/00*** | (2006.01) |
| ***C22C 38/02*** | (2006.01) |
| ***C22C 38/04*** | (2006.01) |

(Continued)

(52) U.S. Cl.
CPC ..... *C23C 8/32* (2013.01); *C21D 1/06* (2013.01); *C21D 9/36* (2013.01); *C21D 9/40* (2013.01); *C22C 38/002* (2013.01); *C22C 38/02* (2013.01); *C22C 38/04* (2013.01); *C22C 38/06* (2013.01); *C22C 38/08* (2013.01); *C22C 38/22* (2013.01); *C23C 8/34* (2013.01); *C23C 8/56* (2013.01); *C23C 8/80* (2013.01); *C23F 17/00* (2013.01)

(58) Field of Classification Search
CPC ..... C23C 8/32
USPC ..... 148/218
See application file for complete search history.

(56) References Cited

U.S. PATENT DOCUMENTS 4,563,223 A 1/1986 Dawes et al.

FOREIGN PATENT DOCUMENTS

CN 101187027 A 5/2008
CN 102154652 A 8/2011

(Continued)

OTHER PUBLICATIONS

Stål och Värmebehandling En handbok, Swerea IVF, 2010, p. 379-381, 490-493, 499-501, 520-523.

(Continued)

*Primary Examiner* — Brian D Walck
(74) *Attorney, Agent, or Firm* — Bryan Peckjian; SKF USA Inc. Patent Dept.

(57) ABSTRACT

A method for heat treating a steel component, which comprises the steps of: (a) carbonitriding the steel component, and (b) austenitically nitrocarburizing the steel component.

14 Claims, 3 Drawing Sheets

(51) Int. Cl.

| | |
|---|---|
| ***C22C 38/06*** | (2006.01) |
| ***C22C 38/08*** | (2006.01) |
| ***C22C 38/22*** | (2006.01) |
| ***C23C 8/56*** | (2006.01) |
| ***C23F 17/00*** | (2006.01) |

(56) References Cited

FOREIGN PATENT DOCUMENTS

| | | | |
|---|---|---|---|
| DE | 4205647 | A1 | 8/1993 |
| DE | 4327440 | A1 | 2/1995 |
| GB | 1461083 | A | 1/1977 |

OTHER PUBLICATIONS

Isabella Flodström: "Nitrocarburizing and High Temperature Nitriding of Steels in Bearing Applications Master of Science Thesis" Feb. 11, 2012 XP052241313.

Ovako: "100CrM07-4 Material data sheet", Feb. 6, 2017 (Feb. 6, 2017), pp. 1-3, XP055349391, Retrieved from the Internet: URL: https://steelnavigator.ovako.com/steel-grades/100crmo7 -4/pdf.

Lucefin Group: "100CrM07-3 Material Data sheet", Jan. 25, 2012 (Jan. 25, 2012), XP055349390, Retrieved from the Internet: URL: http://www.lucefin.com/wp-content/files_mf/1.3536100crmo73ing.pdf.

METHOD AND STEEL COMPONENT

CROSS REFERENCE TO RELATED APPLICATIONS

This is a National Stage Application claiming the benefit of International Application Number PCT/SE2013/000126 filed on 19 Aug. 2013, which claims the benefit of Sweden Patent Application Serial Number 1200503-9, filed on 21 Aug. 2012, both of which are incorporated herein by reference in their entireties.

TECHNICAL FIELD

The present invention concerns a method for heat treating a steel component, and a steel component that has been subjected to such a method.

BACKGROUND OF THE INVENTION

Carbonitriding is a metallurgical surface modification technique that is used to increase the surface hardness of a metal component, thereby reducing the wear of the component during use. During the carbonitriding process, atoms of carbon and nitrogen diffuse interstitially into the metal, creating barriers to slip and increasing the hardness near the surface, typically in a layer that is 0.1 to 0.3 mm thick. Carbonitriding is usually carried out a temperature of 850-860° C.

Carbonitriding is normally used to improve the wear resistance of steel components comprising low or medium carbon steel, and not high carbon steel. Although steel components comprising high carbon steel are stronger, they have been found to be more susceptible to cracking in certain applications. Components may for example be used in typically dirty environments where lubricating oil is easily contaminated, such as in a gear box, and it is well known that the service life of components can decrease considerably under such conditions. Particles in the lubricant can namely get in between the various moving parts of a gear box, for example, and make indentations in their contact surfaces. Stress is concentrated around the edges of these indentations and the contact stress concentrations may eventually lead to fatigue cracking. Using components damaged in this way may also result in an increase in the noise generated by the components.

Austenitic nitrocarburizing is a surface hardening process in which nitrogen and carbon are supplied to the surface of a ferrous metal. It produces a thin, hard case consisting of a ceramic iron-nitrocarbide layer (compound layer) and an underlying diffusion zone where nitrogen and carbon are dissolved in the matrix. Austenitic nitrocarburizing is most commonly used on low-carbon, low-alloy steels.

SUMMARY OF THE INVENTION

An object of the invention is to provide an improved method for heat treating a steel.

This object is achieved by a method that comprises the steps of a) carbonitriding the steel component, and b) austenitically nitrocarburizing the steel component, whereby these steps are preferably carried out sequentially.

Changing the microstructure of the surface of the steel component using such a method improves its wear resistance, corrosion resistance, load bearing capacity, surface hardness, core hardness, compound layer thickness, abrasive wear resistance, adhesive wear resistance, and/or fatigue resistance and enhances its ability to relax stress concentration at the edges of any indentations in its surface.

The surface of a steel component subjected to such a method may be provided with a surface hardness of 800-1000 HV or higher, and a core hardness of 300-500 HV depending on the type of steel used. Compared with the prior art, the hardness of both the surface and the core of a high carbon steel component subjected to such a method is greater than that of known components comprising steel having a low carbon content. The wear resistance and fatigue strength for rolling contact are improved as a result. Furthermore, the loading capacity of a steel component, such as a bearing, will be increased, whereby the bearing may be of smaller construction for a particular application. The fatigue resistance on rolling contact also increases, so that the service life of the steel component can be extended. Additionally, the disadvantage that through cracking occurs, described in the prior art, is not found.

The steel component may, as a result of said method, be provided with a compound layer having a thickness of 15-40 μm measured from the surface of the steel component. According to an embodiment of the invention the steel component may also be provided with an intermediate layer having a thickness of 5-15 μm below said compound layer. Nitrogen that has diffused into the surface of the steel component lowers the austenitization temperature and an intermediate layer is formed between the compound layer and the diffusion zone.

By tempering the intermediate layer, at 200-400° C. for two to four hours for example, it can be transformed to a layer having a hardness above 1000 HV which further increases the load bearing capacity of the steel component. When tempered, the intermediate layer transforms into a hard, nitrogen-rich material resulting in a hardness increase to support the compound layer.

According to an embodiment of the invention step b) is carried out at a temperature of 590-700° C. Such a process temperature induces little shape distortion in the steel component, which means that post-grinding is not necessary. The method is therefore a cost-efficient way of increasing the wear and corrosion resistance of a steel component.

According to an embodiment of the invention step b) may be carried out using gaseous, salt bath, ion or plasma or fluidized bed austenitic nitrocarburizing.

According to an embodiment of the invention the steel component comprises steel with a carbon content of 0.60 to 1.20 weight %, i.e. steel with a medium to high carbon content. According to an embodiment of the invention the steel component comprises a high carbon bearing steel such as SAE 52100/100Cr6 or ASTM-A485 grade 2.

According to a further embodiment of the invention the steel component comprises an 100CrMo7-4 steel or any other steel in accordance with ISO 683-17:1999.

According to an embodiment of the invention the steel component comprises or constitutes a rolling element or roller, or a steel component for an application in which is subjected to alternating Hertzian stresses.

According to an embodiment of the invention step b) is carried out in an atmosphere of 60% $NH_3$, 35% $N_2$ and 5% $CO_2$.

According to another embodiment of the invention step a) comprises carbonitriding the steel component for 5-25 hours.

According to a further embodiment of the invention the method comprises the step of tumbling the steel component after step b), although not necessarily directly after step b). Tumbling a steel component after austenitic nitrocarburizing provides a finer surface finish and can be used to further improve the fatigue resistance of the steel component.

According to an embodiment of the invention the method comprises the steps of c) quenching the steel component and d) tempering the steel component. Step d) may be carried out at a temperature of 200-400° C.

According to an embodiment of the invention the method comprises the step of flash oxidizing the steel component after step b).

The present invention also concerns a component made of steel that has a surface hardness of 800-1000 HV or higher and a core hardness of 300-500 HV. Such a steel component may be produced using a method according to any of the embodiments of the invention.

According to an embodiment of the invention the steel comprises a compound layer having a thickness of 15-40 μm. According to another embodiment of the invention the steel comprises an intermediate layer having a thickness of 5-15 μm below said compound layer.

According to another embodiment of the invention the steel has a carbon content of 0.60 to 1.20 weight %.

According to a further embodiment of the invention the steel comprises a 100CrMo7-4 steel.

According to an embodiment of the invention the steel component comprises or constitutes a rolling element or roller, or a steel component for an application in which is subjected to alternating Hertzian stresses, such as rolling contact or combined rolling and sliding, such as a slewing bearing or a raceway for a bearing. The component may include or constitute gear teeth, a cam, shaft, bearing, fastener, pin, automotive clutch plate, tool, or a die. The steel component may for example constitute at least part of a roller bearing, a needle bearing, a tapered roller bearing, a spherical roller bearing, a toroidal roller bearing or a thrust bearing. The component may be used in automotive wind, marine, metal producing or other machine applications which require high wear resistance and/or high corrosion resistance and/or increased fatigue and/or tensile strength.

BRIEF DESCRIPTION OF THE DRAWINGS

The present invention will hereinafter be further explained by means of non-limiting examples with reference to the appended figures where.

It should be noted that the drawings have not been drawn to scale and that the dimensions of certain features have been exaggerated for the sake of clarity.

DETAILED DESCRIPTION OF EMBODIMENTS

Figure 1:
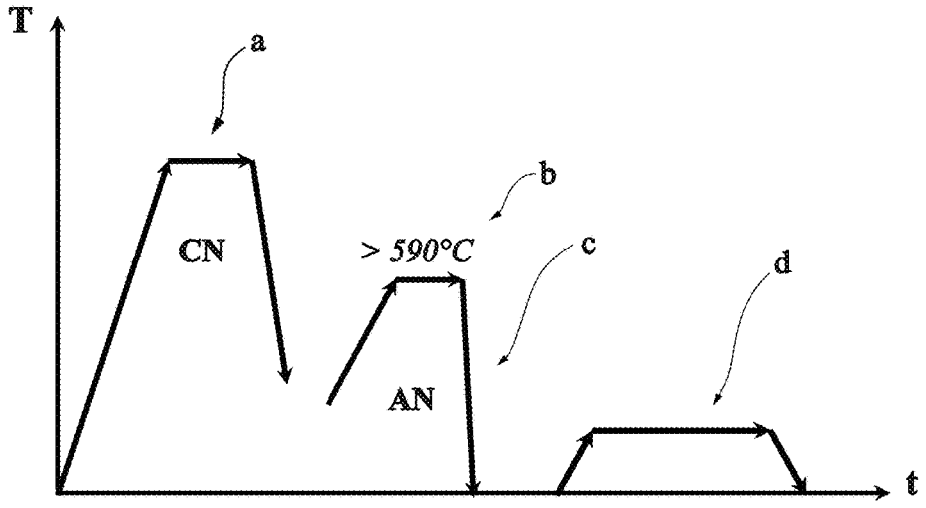
FIG. 1 shows a method according to an embodiment of the invention.

FIG. 1 shows a heat treatment cycle according to the present invention. A steel component is subjected to a carbonitriding process (step a)), at a temperature of 970° C. for 5-25 hours for example. The process environment is for example provided by the introduction of methane/propane/natural gas (for carbon) and ammonia (for nitrogen) into a furnace in the presence of a controlled carrier gas. By maintaining the proper ratios of the working gases, the component is provided with a thin carbonitrided layer of carbon- and nitrogen-rich steel. According to an embodiment of the invention the method includes supplying a higher concentration of ammonia at the beginning of the carbonitriding step a) to boost the carbonitriding process. For example, 9.5% ammonia may be used initially; this may be lowered to 6.5% ammonia and then 0%. 9.5% ammonia may be used for about 70% of the carbonitriding step a). The load bearing capacity of the steel component is increased by the carbonitriding step a). The load bearing capacity depends on the case depth reached by carbonitriding and the temperature used for austenitic nitrocarburizing.

The steel component is then austenitically nitrocarburized (step b)), by re-heating the component to a temperature of at a temperature of 590-700° C., in an atmosphere of 60% NH3, 35% N2 and 5% CO2 for example. The austenitic nitrocarburizing step b) provides the steel component with a tough tempered core and a hard ceramic-like surface, an intermediate layer and a diffusion zone.

The steel component may subsequently be quenched (step c)) in an oil or salt bath with bath temperatures selected to achieve the optimum properties with acceptable levels of dimensional change. Hot oil/salt bath quenching can be used to minimize distortion of intricate parts. Low temperature tempering (step d)) may then be carried out to toughen the steel component, for example at a temperature of 200-400° C. After tempering, the component is cooled to room temperature and may then be used in any application in which it is likely to be subjected to stress, strain, impact and/or wear under a normal operational cycle, such as in under contaminated and/or poor lubricant conditions.

According to an embodiment of the invention the method may comprise the step of tumbling the steel component after step b).

Such a method will improve at least one of the following properties of a steel component: wear resistance, corrosion resistance, load bearing capacity, surface hardness, core hardness, compound layer thickness, abrasive wear resistance, fatigue resistance.

Steel components subjected to a method according to an embodiment of the present invention may be used with or without subsequent grinding operations.

The steel component may comprise steel with a carbon content of 0.60 to 1.20 weight %, or 100CrMo7-4 steel.

Such a method may be used to heat treat a steel component that comprises or constitutes a rolling element or roller, or a steel component for an application in which is subjected to alternating Hertzian stresses, particularly in applications with high demands on wear and/or corrosion resistance.

Figure 2:
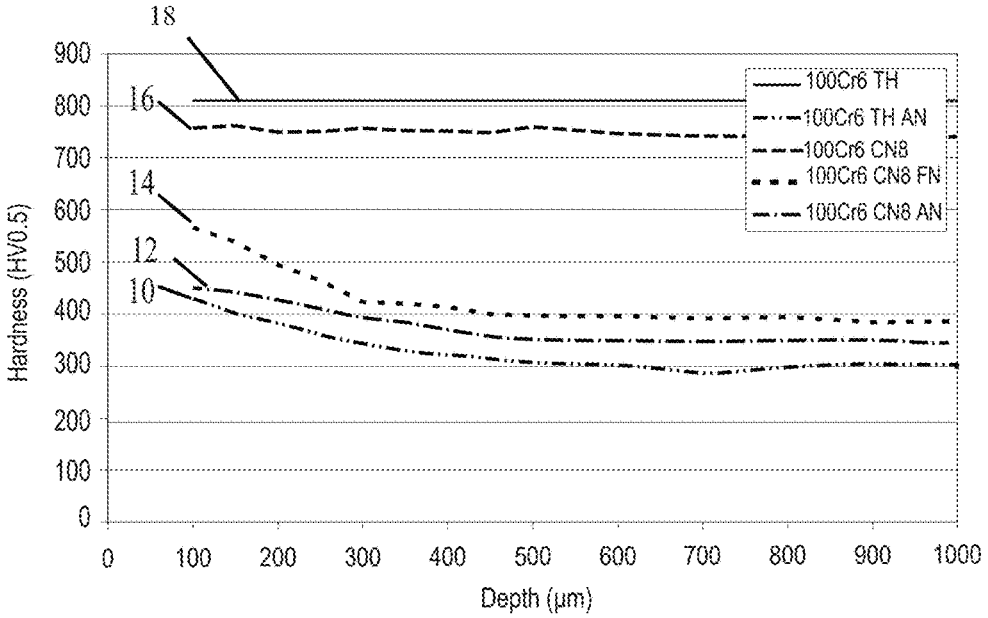
FIG. 2 shows Micro Vickers hardness profiles of five steel materials that have been subjected to different heat treatments.

FIG. 2 shows a graph of Micro Vickers hardness profiles at 0.1 to 1 mm depth below the surface of a five steel materials 10, 12, 14, 16, 18 that were subjected to different heat treatments.

Material 10 was 100Cr6 steel that had been through hardened and austenitically nitrocarburized.

Material 12 was 100Cr6 steel that had been carbonitrided for 8 hours, re-hardened and austenitically nitrocarburized according to an embodiment of the present invention.

Material 14 was 100Cr6 steel that had been carbonitrided for 8 hours, re-hardened and feritically nitrocarburized.

Material 16 was 100Cr6 steel that had been carbonitrided for 8 hours and re-hardened.

Material 18 was 100Cr6 steel that had been through hardened.

Samples of material 12 were austenitically nitrocarburized in a seal quench furnace at 620° C. for 2.5 hours in an atmosphere of 60% NH3, 35% N2 and 5% CO2. Thereafter they were quenched in oil at 60° C. and tempered at 180° C.

Samples of material 14 were ferritically nitrocarburized in a seal quench furnace at 580° C. for 2.5 hours in an atmosphere of 60% NH3, 35% N2 and 5% CO2. Thereafter they were quenched in oil at 60° C. and tempered at 180° C.

Austenitic and ferritic nitrocarburizing were namely carried out under the same conditions except that the nitrocarburizing temperature in austenitic nitrocarburizing was higher than in ferritic nitrocarburizing. The main difference seen when increasing the process temperature from ferritic to austenitic nitrocarburizing was an increase in the compound layer thickness and the appearance of an intermediate layer in between the compound layer and the substrate in austenitically nitrocarburized samples. The temperature for austenitic nitrocarburizing was selected to be high enough so that an intermediate layer would be formed below the compound layer, but to be as low as possible to minimize distortions. Just before quenching, the samples were exposed to the atmosphere for a few seconds. This so called flash oxidation produced a thin oxide layer on the surface of the samples.

Austenitic nitrocarburizing resulted in a thicker compound layer and a deeper nitrocarburizing depth than that obtained by ferritic nitrocarburizing, and provides better load bearing capacity than ferritic nitrocarburizing since it results in both a thicker compound later and deeper nitrocarburizing depth.

Carbonitriding prior to nitrocarburizing increases both the diffusion zone and the core hardness, i.e. the hardness of the base material, compared to materials that are nitrocarburized in the soft condition, i.e. without carbonitriding prior to nitrocarburizing. However, the diffusion zone and core hardness is low compared to materials that are carbonitrided only.

Figure 3:
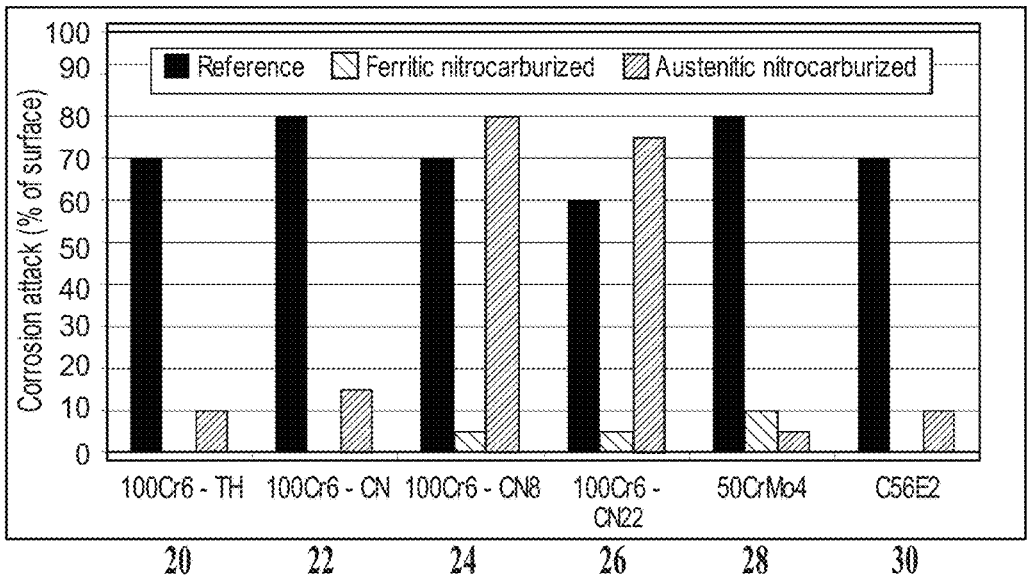
FIG. 3 shows the corrosion attack on six different materials subjected to different heat treatments.

FIG. 3 shows the corrosion attack on both ferittically and austenitically nitrocarburized materials 20, 22, 24, 26, 28 and 30 after 104 in neutral salt spray.

Material 20 was 100Cr6 steel that had been through hardened

Material 22 was 100Cr6 steel that had been carbonitrided for 22 hours.

Material 24 was 100Cr6 steel that had been carbonitrided for 8 hours and re-hardened.

Material 26 was 100Cr6 steel that had been carbonitrided for 22 hours and re-hardened.

Material 28 was 50CrMo4 steel.

Material 30 was C56E2 steel that had been carbonitrided for 8 hours and re-hardened.

Samples of all of the materials 20, 22, 24, 26, 28 and 30 were corrosion tested after they had been subjected to the heat treatments described above (see "reference" values in FIG. 3), and then after ferritic nitrocarburizing or austenitic nitrocarburizing. It can be seen from FIG. 3 that the samples 20, 22, 28 and 30 subjected to heat treatments according to an embodiment of the invention exhibited very good corrosion resistance. After 104 hours in neutral salt spray, only 5-15% of the surface of these samples was corroded. The corrosion attack for samples 24 and 26 was however worse than the corrosion attack the reference material. The re-hardening step of the carbonitriding process seems to be responsible for the decreased corrosion resistance of samples 24 and 26 after austenitic nitrocarburizing. The sample 22 that was carbonitrided but not re-hardened showed improved corrosion resistance after austenitic nitrocarburizing.

Figure 4:
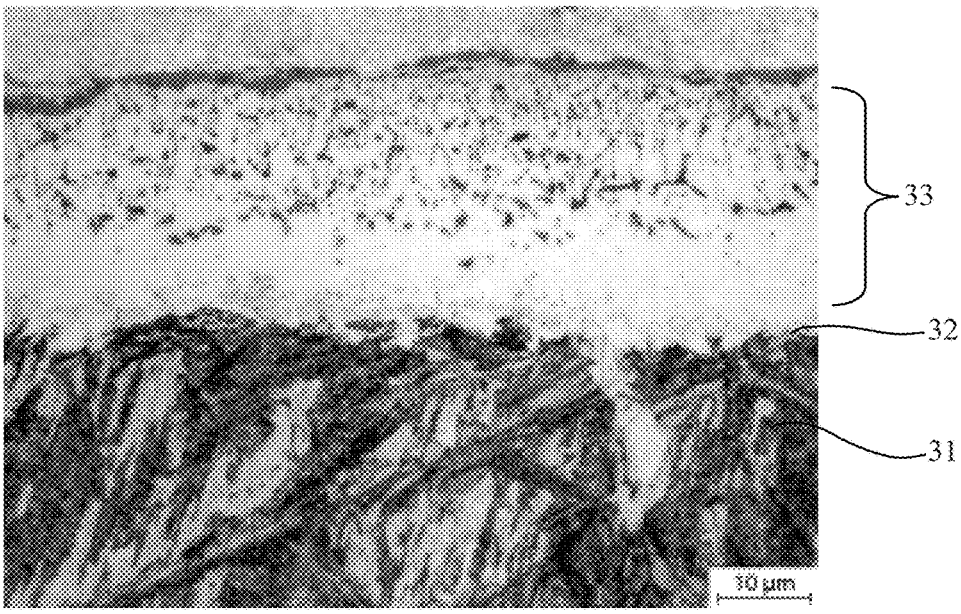
FIG. 4 shows a micrograph of 100CrMo7-4 steel that has been carbonitrided and austenitically nitrocarburized.

FIG. 4 is a micrograph showing 100CrMo7-4 steel that had been carbonitrided and austenitically nitrocarburized in accordance with a method according to the present invention. The steel sample was not tempered after nitrocarburizing.

The method according to the present invention produces a thin, hard case consisting of a ceramic iron-nitrocarbide layer (compound layer 33, an intermediate layer 32) and an underlying diffusion zone 31 where nitrogen and carbon are dissolved in the matrix.

Steel components subjected to a method according to the present invention are, as a result of the method, provided with a compound layer 33 having a thickness of 15-40 μm, a surface hardness of 800-1000 HV or higher, which suggests a high resistance to abrasive wear, and a core hardness of 300-500 HV. Since the core is tough tempered, its crack propagation rate is low. Furthermore, it is believed that the compound layer 33 contains mostly ε-phase, which implies good resistance to adhesive wear and improved corrosion resistance.

Figure 5:
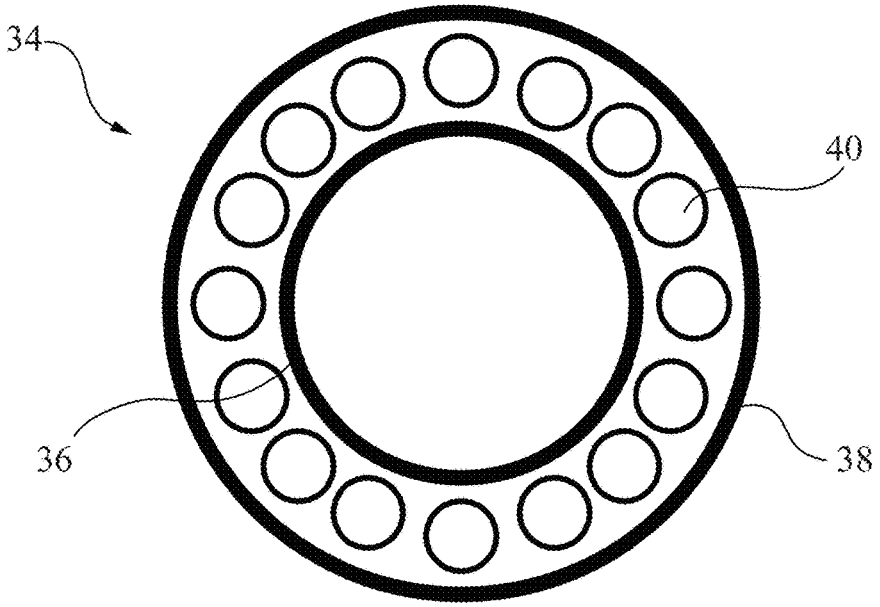
FIG. 5 shows a steel component according to an embodiment of the invention.

FIG. 5 shows an example of a steel component according to an embodiment of the invention, namely a rolling element bearing 34 that may range in size from 10 mm diameter to a few metres diameter and have a load-carrying capacity from a few tens of grams to many thousands of tonnes. The bearing 34 according to the present invention may namely be of any size and have any load-carrying capacity. The bearing 34 has an inner ring 36 and an outer ring 38 and a set of rolling elements 40. The inner ring 36, the outer ring 38 and/or the rolling elements 40 of the rolling element bearing 34, and preferably at least part of the surface of all of the rolling contact parts of the rolling element bearing 40 may be subjected to a method according to the present invention.

Further modifications of the invention within the scope of the claims would be apparent to a skilled person.

The invention claimed is:

1. A method for heat treating a steel component, the method comprising steps of:

a) carbonitriding the steel component, wherein the carbonitriding is initially carried out in a carbonitriding atmosphere having 9.5% ammonia, b) reducing a percentage of ammonia in the carbonitriding atmosphere to 6.5% ammonia after 70% of the carbonitriding is completed, and c) austenitically nitrocarburizing the steel component, wherein the austenitically nitrocarburizing is carried out in an atmosphere of 60% $NH_3$, 35% $N_2$ and 5% $CO_2$.

2. The method according to claim 1, wherein the step of austenitically nitrocarburizing the steel component is carried out at a temperature of 590-700° C.

3. The method according to claim 1, wherein the steel component comprises steel with a carbon content of 0.60 to 1.20 weight %.

4. The method according to claim 1, wherein the steel component comprises a 100CrMo7-4 steel.

5. The method according to claim 1, wherein the steel component comprises or constitutes one of a rolling element, a roller, or a steel component for an application in which the steel component is subjected to alternating Hertzian stresses.

6. The method according to claim 1, wherein, as a result of the method, the steel component is provided with a compound layer having a thickness of 15-40 μm.

7. The method according to claim 6, wherein, as a result of the method, the steel component is provided with an intermediate layer having a thickness of 5-15 μm below the compound layer.

8. The method according to claim 1, wherein, as a result of the method, the steel component is provided with a surface hardness of 800-1000 HV and a core hardness of 300-500 HV.

9. The method according to claim 1, wherein the step of carbonitriding the steel component comprises carbonitriding the steel component for 5-25 hours.

10. The method according to claim 1, the method further comprising a step of tumbling the steel component after the step of austenitically nitrocarburizing the steel component.

11. The method according to claim 1, the method further comprising steps of c) quenching the steel component and d) tempering the steel component.

12. The method according to claim 9, wherein the step of tempering the steel component is carried out at a temperature of 150-260° C.

13. The method according to claim 1, wherein the method results in improving at least one of the following properties of a steel component: wear resistance, corrosion resistance, load bearing capacity, surface hardness, core hardness, compound layer thickness, abrasive wear, and fatigue resistance.

14. A method according to claim 1, the method further comprising a step of flash oxidizing the steel component after the step of austenitically nitrocarburizing the steel component.

* * * * *